United States Patent [19]

Council, Jr.

[11] Patent Number: 4,680,998

[45] Date of Patent: Jul. 21, 1987

[54] TORIC LENSES, METHOD AND APPARATUS FOR MAKING SAME

[75] Inventor: Buford W. Council, Jr., Ruskin, Fla.

[73] Assignee: Bausch & Lomb Incorporated, Rochester, N.Y.

[21] Appl. No.: 645,147

[22] Filed: Aug. 28, 1984

[51] Int. Cl.[4] ..... B23B 1/00; B23B 5/40

[52] U.S. Cl. ..... 82/1 C; 82/2 B; 82/12; 82/18; 82/24 R; 51/58; 51/124 L; 51/284 R

[58] Field of Search ..... 82/1 C, 2 B, 12, 18, 82/24 R, DIG. 9; 51/284 R, 124 L, 58

[56] References Cited

U.S. PATENT DOCUMENTS

| | | | |
|---|---|---|---|
| 3,900,972 | 8/1975 | Rupp | 51/284 R |
| 3,902,277 | 9/1975 | Rupp | 51/284 R |
| 3,913,274 | 10/1975 | Raiford et al. | 82/12 |
| 4,178,720 | 12/1979 | Hashimoto | 51/124 L |
| 4,203,062 | 5/1980 | Bathen | 82/2 B |
| 4,250,779 | 2/1981 | Feller et al. | 82/2 B |
| 4,264,249 | 4/1981 | Dawson | 82/12 |
| 4,455,901 | 6/1984 | Council | 82/12 |

FOREIGN PATENT DOCUMENTS

| | | | |
|---|---|---|---|
| 984693 | 12/1982 | U.S.S.R. | 82/12 |

*Primary Examiner*—Nicholas P. Godici
*Assistant Examiner*—Jerry Kearns
*Attorney, Agent, or Firm*—John S. Norton

[57] ABSTRACT

A unique lens (10) having a peripheral carrier surface (13), a central optical zone (18) providing the toricity required to achieve a given spherical and cyclinder correction that is oriented to a selected axis angle ($\psi$) and an intermediate, annular, transitional surface (15) between the optical and carrier surfaces (16 and 13). The method and apparatus for providing such a toric lens (10) employs a generator (50) that produces a sinusoidal signal in response to rotaton of the lathe spindle (26), and a signal that is selectively phased at a predetermined angularity with respect to the circumference of the rotatable spindle (26). The aforesaid signal is applied to a tool post oscillator (90) in order to oscillate the tool (36) in synchronization with rotation of the spindle (26) thereby cutting both curves of the toric surface (16) in one pass. The signal is also modulated (140) in response to the rotational swing of the quadrant (3) on which the cutting tool is supported progressively to null the signal as the cutting tool (36) approaches the apex (22) of the optical zone (18), thus permitting the two curves of the toric, optical surface to merge smoothly at the apex (22). Finally, a switch/ramp control (170) is employed to provide no oscillations of the cutting tool as the carrier surface (13) is lathe-cut and thereafter gradually to increase the signal to the tool oscillator (90) in order to cut an annular transitional surface (15) between the carrier and optical surfaces (13 and 16).

17 Claims, 11 Drawing Figures

TORIC LENSES, METHOD AND APPARATUS FOR MAKING SAME

TECHNICAL FIELD

The present invention relates generally to eye glasses, or lenses, and the means by which to impart the desired corrective prescription thereto. More particularly, the present invention relates to corrective eye glasses, or lenses, and the means by which to impart an astigmatic prescription thereon. Specifically, the present invention relates to a novel method and apparatus by which more accurately to impart toricity to a lens, including even soft contact lenses, and the novel lens which results therefrom.

BACKGROUND ART

The human eye is like a camera, with the cornea and crystalline lens comprising the lens system and with the retina comprising the film on which the image is formed. If the eye has no refractive error—emmetropia—parallel rays of light entering the eye are focused exactly on the macula in the center of the retina, the area of clearest vision. Some people are indeed fortunate enough to have eyes which at least approximate an emmetropic condition. The majority of human eyes, however, are ametropic. That is, light, and images, are not focused exactly on the retina owing to some abnormality of the refracting mechanism.

Hypermetropia, or farsightedness, is a form of ametropia in which light, or images, nearer than a certain distance, cannot be focused properly on the retina, but rather, are focused behind it. Hypermetropia is corrected by use of a positive lens—typically a convex meniscus.

Myopia, or nearsightedness, is a form of ametropia, in which objects further than a short distance away are not focused on the retina, but rather, are focused in front of it. The so-called "far-point" (the farthest point at which the eye can focus objects) is rather close instead of being at infinity, as it is for the emmetropic eye. At the same time the "near-point" (the nearest point at which the eye can focus objects) is rather closer than for the emmetropic eye. Myopia is corrected by use of negative lenses—typically a concave meniscus.

Positive and negative lens corrections are achieved by the use of lenses having spherical surfaces. Even though a lathe attachment embodying the present invention can be operated to produce lenses having wholly spherical refractive correction, its primary advantage is in being able to provide non-spherical lens surfaces, as required to correct for astigmatism, with equal facility to the production of the relatively uncomplicated spherical lenses.

Astigmatism is a refractive abnormality in which there is a simultaneous difference of curvature in the meridians of the lens mechanism in the same eye. As a result of astigmatism light rays are not focused on the retina as points but as lines of points, and vision is blurred. Astigmatism may be "simple" in that it may be the sole refractive abnormality. More commonly, however, astigmatism may coexist with another refractive abnormality. If astigmatism occurs in conjunction with nearsightedness, a person has myopic astigmatism; if astigmatism occurs in conjunction with farsightedness, a person has hyperoptic astigmatism. Additionally, it should be recognized that mixed astigmatism may exist. That is, the eye may be farsighted in one meridian and be nearsighted in the opposite meridian. The two meridians are orthogonal, but they are not necessarily aligned with the horizontal and vertical planes of the eye.

Astigmatism is corrected by the use of cyclindrical, rather than spherical, correction. Whereas a lens providing spherical correction has a single focal point, a lens providing cylindrical correction has two focal points. This occurs because lenses providing cylindrical correction have a first radius of curvature in one meridian and a second radius of curvature in the second meridian.

If one generates a geometric shape, for example, by revolving a circle about a coplanar line outside the circle, the result is a torus. A doughnut, or a tire innertube, are examples of such a torus. If one then removes a small section from the radially outermost portion of the torus, that section will have two radii of curvature. Along one meridian the section will have a radius of curvature equal to the radius of the circle that was revolved for generating the torus, and along the orthogonal meridian the section will have a radius of curvature equal to the radius measured from the coplanar line about which the circle was revolved to the radially outermost extent of the circle. Such a section will then be designated as having a "toric" configuration, and a lens which provides cylindrical correction, because it similarly has two different-radii of curvature along its orthogonal meridians, can also be designated as a toric lens.

The orientation of the orthogonal meridians of the lens into congruence with the refractive correction required for the eye is directly related to the "axis" of the lens prescription. The axis is designated as the plane of the spherical refractive correction—that is, the angle measured from a horizontal reference plane to the meridian of the most plus power correction. The plane of the most plus power correction—the spherical refractive correction—may coincide with the horizontal plane of the eye itself, but it does not generally do so. As such, an orientation system has been established whereby the horizontal plane of the eye is designated, in the mathematical style, as the 0°-180° plane. The vertical plane of the eye is similarly mathematically designated as the 90°-270° plane. The axis of the lens is thus referenced as the angle measured by the aforesaid convention to the most plus corrective power. The most common axes are 0°, 10°, 20°, 70°, 80°, 90°, 100°, 110°, 160° and 170°.

The second radius, or the cylinder, of the lens is at 90° to the spherical correction.

With this background, then, the prescription required to establish the refractive correction for an astigmatic eye constitutes three parts: the spherical correction, the cylinder and the axis. The radius required to provide the diopter correction for the spherical correction is mathematically determined, and by algebraically adding the cylinder to the spherical correction, the orthogonal radius is also mathematically determined. The orientation of these two orthogonal radii of curvature are then determined by the axis.

The grinding techniques employed to impart the properly oriented two radii of curvature to a standard lens were not really adaptable to the making of contact lenses, and new techniques were developed. One of the most widely employed techniques to create a toric contact lens is to grind, or lathe-cut, and polish the spherical correction onto the concave inner surface of the lens. Thereafter, the rim of the lens is firmly grasped by jaws that impart diametrically opposed forces to the lens. The opposed forces so applied oblate the lens about the locations where the opposed forces are applied. This oblate distortion is then maintained while a second spherical surface of the radius required for the cylindrical correction is ground, or lathe-cut, and polished onto the convex outer surface of the oblated lens. When the distorting force is removed, the lens returns to its original configuration, but the convex outer surface assumes the required toricity to effect refractive correction for astigmatism.

The aforesaid "crimping" process was developed for the so-called "hard" contact lenses and has been successfully adapted for the "soft" contact lenses, as well. However, this crimping method is highly labor intensive and requires a major capital investment for the accurate equipment required to perform the various steps for making such lenses.

There are certain other grinding and/or lap polishing methods that have heretofore been employed to achieve toricity, but all have rather serious drawbacks. For example, two of the better known grinding techniques can only impart toricity to the concave surface of the lens. This is not overly desirable in that better eye contact is achieved if the eye contacting surface can remain spherical.

One other known grinding arrangement has been employed to impart toricity to the convex outer surface of the lens, but this approach can only do so to the entire convex surface, and this can destroy the prismatic ballast employed to orient the lens properly onto the eye.

DISCLOSURE OF THE INVENTION

It is, therefore, an object of the present invention to provide a novel method and apparatus by which to impart toricity to the surface of a lens.

It is another object of the present invention to provide a novel method and apparatus, as above, by which simultaneously to lathe-cut both curves forming the desired toricity onto the surface of a lens.

It is a further object of the present invention to provide a novel method and apparatus, as above, by which to impart the toricity to the convex surface of the lens.

It is yet another object of the present invention to provide a novel method and apparatus, as above, by which to impart toricity to a selected central diameter of the convex surface on a contact lens and yet also impart a spherical carrier surface on the peripheral portion of said lens with a smooth annular transitional surface extending between the carrier and toric surfaces without degrading the prismatic ballast employed for orientation of the lens onto the eye.

It is a still further object of the present invention to provide a novel method and apparatus, as above, by which to obviate the labor intensity and significantly reduce the operational steps and capital investment in equipment heretofore required to produce astigmatic refractive correction on contact lenses.

It is an even further object of the present invention to provide a lens having toricity for the refractive correction of astigmatism that can incorporate prismatic ballast for orientation and have a spherical carrier and smoothly transitional annular surface between the carrier and toric surfaces.

These and other objects, together with the advantages thereof over existing and prior art forms which will become apparent from the following specification, are accomplished by means hereinafter described and claimed.

In general, a method for generating a toric surface on a lens blank according to the concept of the present invention employs a lathe. The lens blank is supported by, and secured with respect to, the lathe spindle, and the spindle is rotated. A cutting tool is mounted on the lathe quadrant, and the quadrant moves the cutting tool along an arcuate path across the lens blank. The cutting tool is selectively oscillated, and, most critically, this oscillation of the cutting tool is accurately synchronized with respect to rotation of the spindle. By predetermining the range of oscillation one can select the innermost incursion of the cutting tool and its outermost retraction—thereby controlling the two orthogonal radii of the resulting toric lens when, although only when, the aforesaid oscillations are synchronized with respect to rotation of the spindle.

Apparatus for generating a toric surface according to the concept of the present invention comprises an attachment assembly for a lathe. The lathe has a rotatable spindle to support a lens blank and a rotatable quadrant on which the cutting tool is supported for movement through an arcuate path transversely of the spindle.

Means are provided for generating a signal in response to rotation of the spindle, and that signal, in turn, effects, and controls, oscillation of the cutting tool. The resulting synchronization of the tool oscillations with respect to rotation of the spindle is critical to the cutting of a toric surface onto a lens blank by means of a lathe.

The aforesaid method and apparatus permits one to make a unique lens wherein the toric surface is confined to a predetermined central area—the optical zone—of the lens. A spherical carrier surface may be generated to circumscribe the toric central portion, and a smooth transitional surface extends annularly between the carrier and toric surfaces. Moreover, the foregoing surfaces may be imparted without any deleterious affect to the prismatic ballast of the lens.

An exemplary embodiment of apparatus for making a unique toric lens embodying the concept of the present invention, said apparatus being suitable for practicing the novel method of the present invention, is shown by way of example in the accompanying drawings and described in detail without attempting to show all of the various forms and modifications in which the invention might be embodied; the invention being measured by the appended claims and not by the details of the specification.

BRIEF DESCRIPTION OF THE DRAWINGS

FIG. 2 is a cross sectional view taken diametrically of the lens depicted in FIG. 1—inasmuch as orthogonal radii cannot be conveniently depicted on a planar surface the larger radius, which is depicted within the plane of the diametric section along which FIG. 2 is taken, is represented by a solid line and the smaller radius, located orthogonally thereto, is depicted by a broken, or dashed, line;

DESCRIPTION OF THE PREFERRED EMBODIMENT

The Toric Lens

The method and apparatus embodying the concept of the present invention constitutes a novel and unique means by which to impart a toric surface to the convex surface of what will be the optical zone of a lens. As such, the method and apparatus can readily be adapted to produce a contact lens—either hard or soft—that is particularly suited for the refractive correction of astigmatism.

Figure 1:
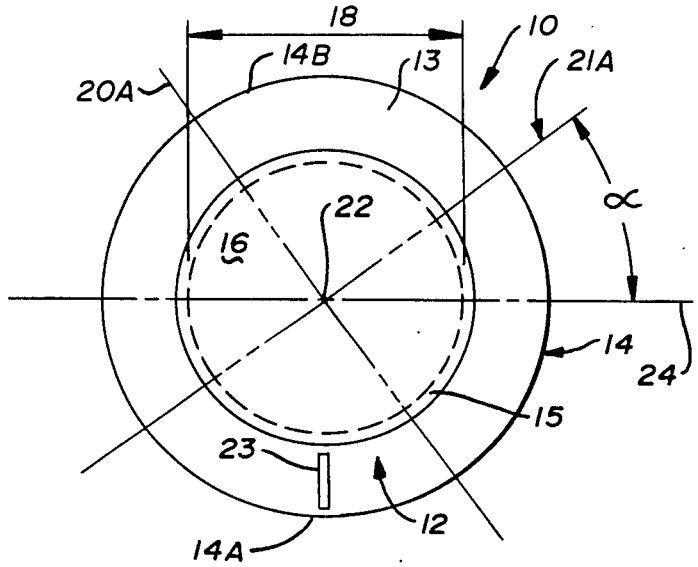
FIG. 1 is an enlarged, frontal elevation of a novel, contact, toric lens made in accordance with, and on apparatus, all of which embody the concept of the present invention.
Figure 2:
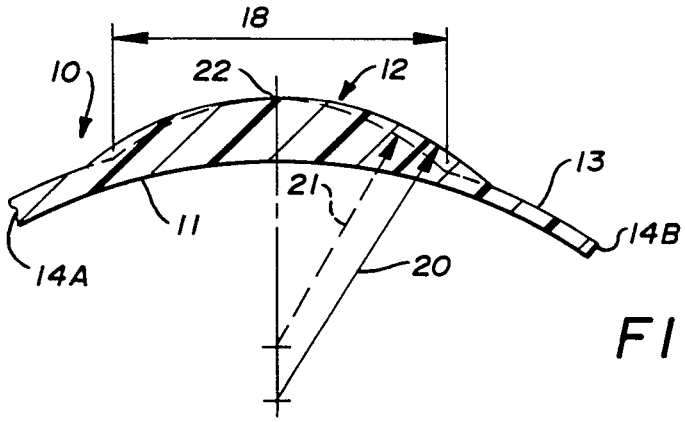

Reference to FIGS. 1 and 2 reveals a contact lens 10 embodying the concept of the present invention and made by virtue of the method and apparatus thereof. The lens 10 has a spherical concave surface 11 for contacting the cornea, and that surface can be provided by any of the well known prior art procedures. The convex face 12 of the lens 10 has a spherical carrier surface 13 that extends peripherally of the lens from the rim 14 to an annular, transitional surface 15. The toric surface 16 is incorporated on the convex face at the central, or optical, zone 18 thereof. The juncture of the transitional surface 15 with the carrier surface 13 is delineated by a solid line in FIG. 1, but the merger of the transitional surface 15 into the toric surface 16 is gradual and thus not accurately represented by a solid line. Accordingly, an approximation of the innermost extent of the transitional surface 15 is represented by a broken, or dashed, line rather than a solid line.

The toric surface 16 has a first radius of curvature 20 designated as the flat radius, and orthogonally with respect thereto is a second radius of curvature 21 designated as the steep radius. It is this toricity which effects the desired refractive correction for astigmatism. The curves defined by the two radii of curvature 20 and 21 meet at a common apex 22 at the center of the optical zone 18. Those skilled in the art will appreciate that the two radii of curvature are preselected to provide the necessary diopter correction, one for each meridian of the eye.

FIG. 2 also reveals that the rim at point 14A is somewhat thicker than the rim at the diametrically opposed point 14B. The difference in dimension between these two thicknesses, as is well known to the art, provides the prismatic ballast by which the lens remains properly oriented on the surface of the eye. One of the plus factors of the present invention is that the prismatic ballast may be lathe-cut in the time-honored prior art manner and it will not be destroyed, or be otherwise deleteriously effected, when the toric surface 16 is cut.

Reference again to FIG. 1 shows that the prismatic ballast point 14B may be marked, as at 23, to assist the clinician who fits the lens in determining the proper vertical, and horizontal, orientation of the lens with respect to the cornea.

That figure also depicts the axis angle $\alpha$ between a true horizontal plane 24 and the meridian of the most plus power of the lens. To relate the designation plus power of the lens to the aforementioned radii of curvature 20 and 21, the steep radius 21 provides the most algebraically plus power of the lens (this still might be a minus power correction if the eye to be corrected has myopic astigmatism), and the flat radius 20 provides the most minus power. By definition, then, the axis $\alpha$ is the angle between the horizontal plane 24 and the meridian 21A of the steep radius 21. The meridian 20A of the flat radius 20 is oriented orthogonally of meridian 21A.

Preface

In order to facilitate an understanding of the present method and apparatus, as employed to produce a toric lens, an overview will be presented to summarize the salient aspects of each. This overview will be followed by a detailed elaboration as to the several principal components of the novel apparatus which embodies the concept of the present invention.

Preliminarily, it must be appreciated that the apparatus embodying the concept of the present invention comprises an attachment to a standard lens making lathe. The Robertson lathe exemplifies the industry standard for making lathe-cut lenses. This lathe semi-automatically produces lenses having spherical surfaces for refractive correction of hypermetropia and myopia, but it cannot cut a toric surface for the refractive correction of astigmatism without such additional steps as those required for the "crimping" process heretofore described. However, when an attachment embodying the concept of the present invention is fitted to such a lathe, a toric surface of the selected radii combination to effect virtually any given spherical, cylinder and axis prescription can be directly lathe-cut onto a lens blank.

The overall attachment is comprised of a series of discrete components which interact as a subassembly to effect the desired performance of the lathe.

The Lens Lathe and Lens Blank

The exemplary lathe 25 (FIG. 6) has a spindle 26 that is presented from the headstock 27 to be rotated at selected speeds. A chuck 28 is secured to the outboard end of the spindle 26 removably to mount a dop 29, and a lens blank 30 may be secured on the axially outboard end of the dop 29.

A quadrant 31 is mounted on the bed 32 of the lathe 25. The quadrant 31 is itself rotatably swung about a vertical axis 33 which is normal to, and intersects, the centerline, or rotational axis, 34 of the spindle 26. A quadrant arm 35 extends radially of the quadrant 31 to support the assembly from which the cutting tool 36 is presented. The attachment which comprises the apparatus of the present invention employs a tool post oscillator 90 from which a standard, diamond cutting tool 36 is presented.

Figure 9:
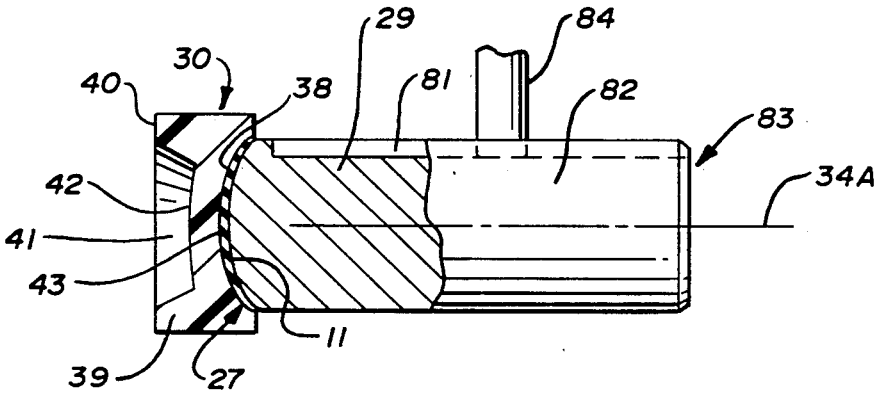
FIG. 9 is a side elevation, partly in section, of a dop to which a lens blank is mounted for being cut to a toric lens and appearing on the same sheet of drawings as FIG. 7.

In the prior art, as in conjunction with the present invention, the dop 29, as best seen in FIG. 9, has a spherical head 38 to which a lens blank 30 is releasably secured, as by means of a dop cement 27 that is compatible with the material of the lens blank 30.

The lens blank 30 itself comprises a cylindrical body portion 39, one end of which terminates in a spherically concave surface that will become the spherical concave surface 11 of the finished lens. This spherically concave surface 11 conforms quite closely to the configuration of the spherically convex dop head 38 such that a substantially uniform layer of cement 27 is interposed therebetween. The end of the cylindrical body portion 39 opposite the spherically concave surface 11 terminates in a transverse surface 40 within which a window 41 is recessed. The window 41 is accurately machined before the lens blank 30 has been secured to the dop head 38 in order to provide an extremely accurate dimension to the lens blank between the generally spherical base 42 of the window 41 and the perigee 43 of the spherically concave surface 11.

The exemplary prior art lathes employ a well known sensor mechanism 130 (FIGS. 4 and 5) that initially engages the base 42 of the window 41 prior the cutting operation and programs the lathe control to limit the maximum axially outward translation of the spindle 26 that will be permitted in order to produce a lens of given thickness at the apex 22 of the optical zone 18. This is well known to the art and need not, therefore, be further described.

One last operation of the prior art lathe that should be borne in mind for the complete background necessary to facilitate a ready understanding of the present invention is the fact that for a spherical lens the corrective radius of curvature is equal to the dimension between the vertical axis 33 about which the quadrant 31 is rotatably swung and the tip of the cutting tool 36 mounted thereon. As will hereinafter become apparent, an attachment embodying the concept of the present invention can also be operated simply to swing the cutting tool 36 about an arc the center of which is coincident with the vertical axis 33 and thereby cut a purely spherical surface.

As is customary in the lens making art, the heretofore identified components are made such that rotational axis 34 of the spindle 26 is oriented slightly eccentrically with respect to the centerline 34A of the dop 29 to which the lens blank 30 is mounted for cutting. This eccentricity produces the prismatic ballast by which the lens maintains its orientation on the eye, as is critically important to the correction of astigmatism. Similarly, the use of such eccentricity to produce prismatic ballast is well known in the prior art and need not be further discussed herein except to note that the operation of an attachment embodying the concept of the present invention to cut a toric surface on the optical zone 18 does not obviate the ability of the lathe to introduce prismatic ballast, as will hereinafter be more fully apparent in conjunction with the operational explanation of the novel lathe attachment, and the components thereof.

Overview of the Lathe Attachment

Figure 3:
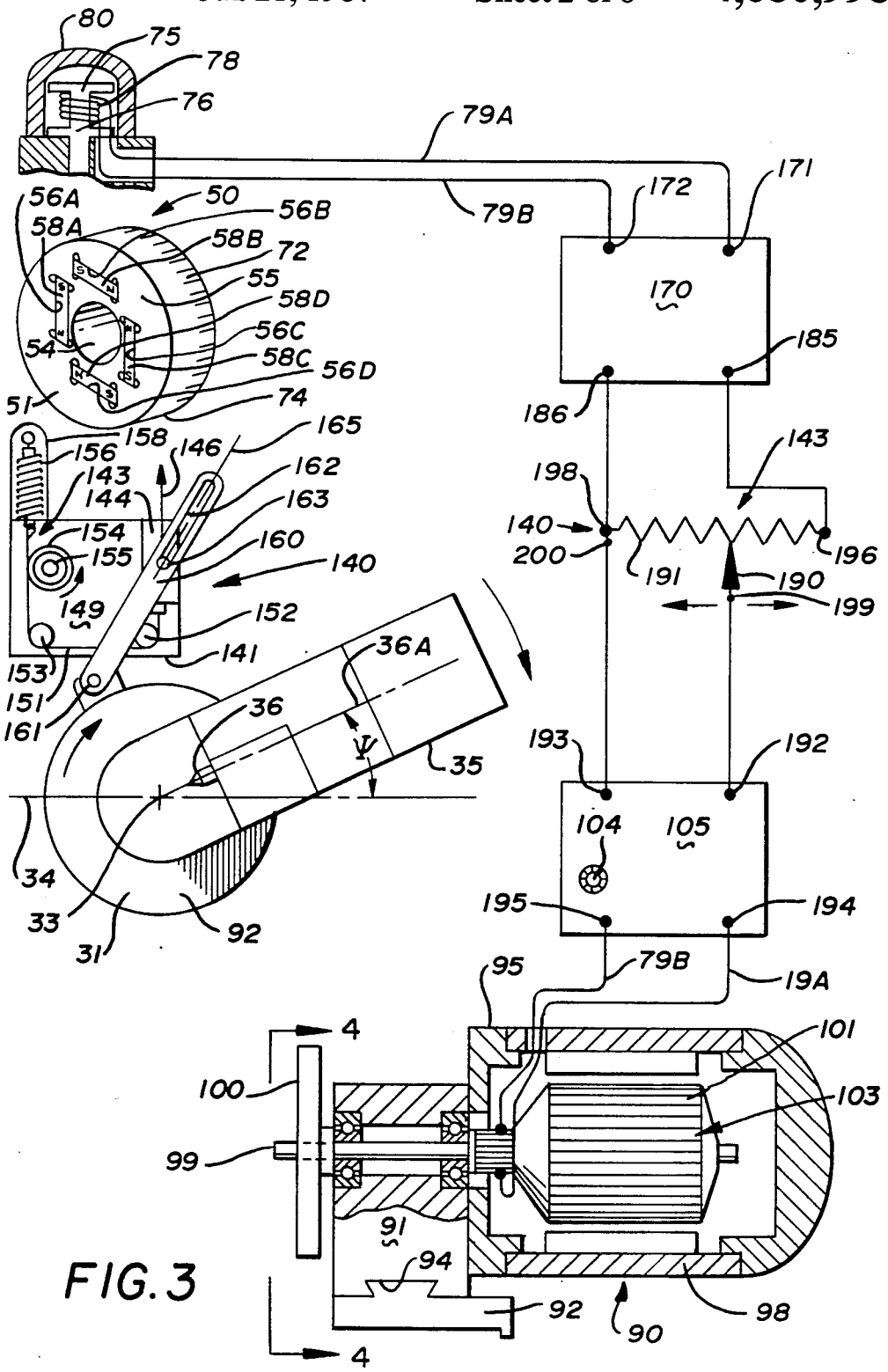
FIG. 3 is a schematic collage depicting apparatus embodying the present invention and capable of being employed with a lens cutting lathe to perform the method thereof in order to produce the novel toric lens thereof—the signal generator component thereof being represented, in part, in perspective and, in part, in vertical section at the upper left hand portion of the drawing; the tool post oscillator being represented in vertical section at the lower right hand portion of the drawing; the mechanical aspect of the modulator being represented in top plan at the middle left hand portion of the drawing; the switch/ramp control and the amplifier both being represented in block diagram form at the top right and right lower middle portions of the drawing, respectively, with the electrically effective aspect of the modulator schematically interposed between the switch/ramp control and the amplifier.
Figure 6:
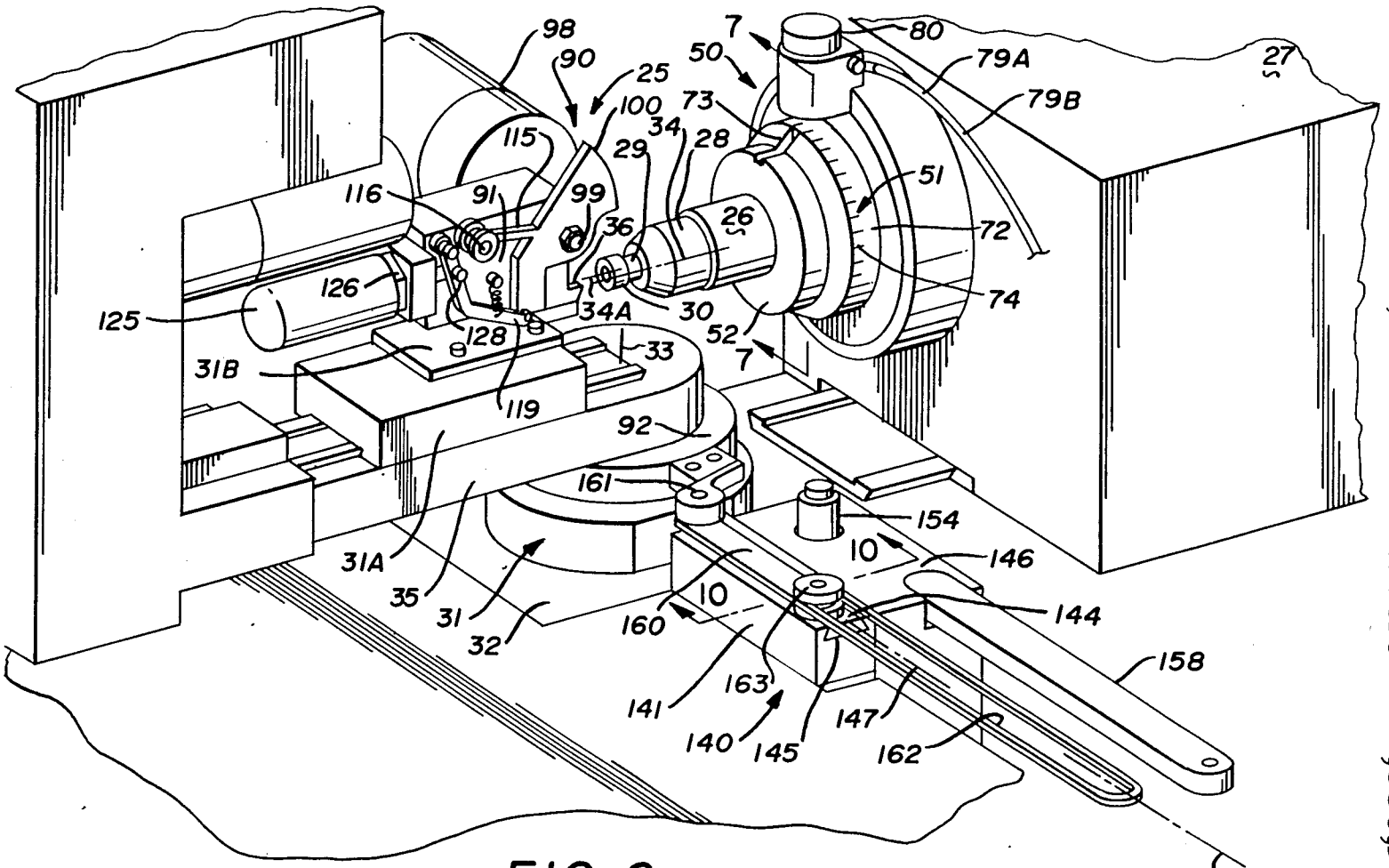
FIG. 6 is a perspective depicting the salient portions of a typical lathe for cutting spherical, corrective lenses and to which apparatus embodying the present invention has been fitted as an attachment that permits such a lathe to cut a toric lens.

With reference, then, to the schematic diagram of FIG. 3 and the perspective of FIG. 6, a signal generator 50 operates in response to rotation of the spindle 26 on the representative lathe 25.

The rotor portion 51 of the signal generator 50 is secured at a selective angular disposition with respect to the spindle 26 for rotation therewith. Orthogonally alternating north and south magnetic poles are provided in the rotor 51 to be rotated with the spindle 26 in order to induce an alternating current signal that is fed to the tool post oscillator 90.

The tool post oscillator 90 is simply carried on the lathe quadrant 31 and does not in any way affect the normal swing of the quadrant 31 about its vertical axis 33. The tool post oscillator 90 may well comprise a fractional horsepower motor 98 from which the brushes have been removed. The alternating current signal supplied by the signal generator 50 is then fed to a selected coil 101 in the armature 103 of the motor 98 so that the motor shaft 99 effects rotational oscillation in response to the signal.

The tool post 100 is operatively secured to the motor shaft 99 (FIGS. 3, 4 and 6) and presents a standard, diamond cutting tool 36 radially of the motor shaft 99 to be oscillated in a plane transversely of the shaft 99.

Because the cutting tool 36 is oscillated by virtue of the signal generated in response to rotation of the spindle 26, the cutting tool 36 incursions effected by the oscillations are exactly synchronized with rotation of the spindle 26. Hence, by creating a current that alternates through two cycles for each revolution of the spindle 26, the cutting tool 36 will always reach its innermost incursion along a first diameter of the spindle 26 and will similarly reach its outermost retraction along a second diameter disposed orthogonally of the said first diameter. These diameters correspond to the meridians 20A and 21A (FIG. 1) of the radii of curvature for the toric surface 16 on the optical zone 18 of the lens 10.

It has been found that proper toricity for refractive correction of astigmatism is best achieved if the waveform of the signal fed to the tool post oscillator 90 is sinusoidal.

At this point it should be explained that as the lathe quadrant 31 swings the cutting tool 36 through the arc necessary to shape the toric surface 16 on the optical zone 18 of the lens 10 it will be necessary to control the amplitude of the cutting tool incursion such that the maximum amplitude occurs near the periphery of the optical zone 18 with a progressive lessening of the amplitude toward the center of the optical zone where the two curves pass through a common apex 22.

A modulator 140 effects the requisite amplitude variations of the tool 36 incursions in response to the angular position $\psi$ of the cutting tool 36 with respect to the rotational axis 34 of the spindle 26.

Inasmuch as the rotational swing of the quadrant 31 moves the cutting tool arcuately across the face of the lens blank, the rotation of the quadrant 31 is employed to effect the desired modulation. It has been found that the desired modulation of the signal varies as the cosine of the angle $\psi$. This function can be achieved by securing a pivotal crank link 160 to the quadrant 31 so that the swing of the quadrant through at least that portion of its rotational movement during which the optical zone 18 is cut translates a slide block 144 that controls the degree to which the signal supplied from the signal generator 50 is modulated before it is applied to the tool post oscillator 90. As shown, the modulator 140 incorporates a potentiometer 143 that is physically actuated progressively to modulate—i.e., reduce—the signal as a function of the cosine of the angle $\psi$ from a maximum at the radially outer periphery of the optical zone 18 to a null when the cutting tool reaches the apex 22 of the optical zone.

With this general overview as to how the optical zone 18 of a toric lens 10 is cut when a standard lens cutting lathe 25 is provided with a subassembly attachment embodying the concept of the present invention, it is presumed that an understanding of the components forming that attachment will be facilitated by the hereinafter detailed description.

Signal Generator

Figure 7:
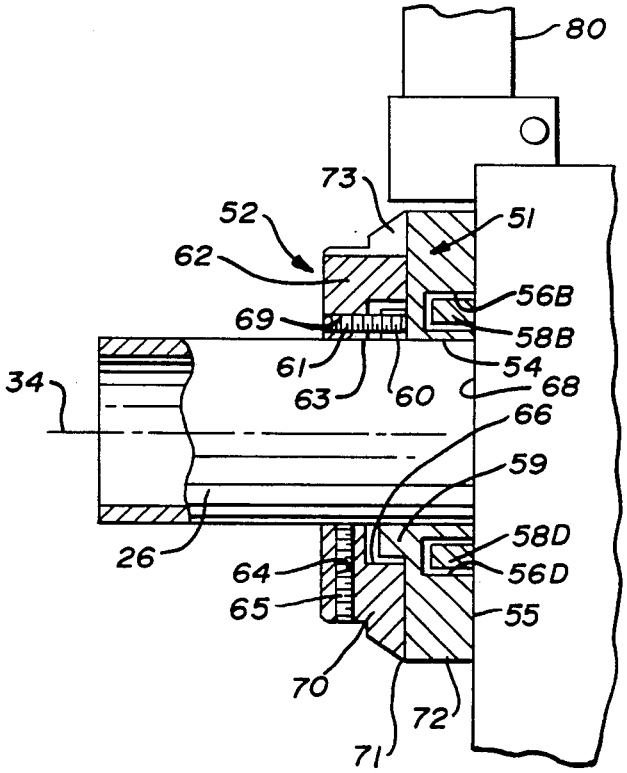
FIG. 7 is an enlarged cross section taken substantially on line 7—7 of FIG. 6 and depicting the rotary portion of the signal generator of the subject invention mounted on the spindle of the lathe.

As best seen in FIGS. 6 and 7, the rotor portion 51 of the signal generator 50 is positioned at a selected angular disposition radially of the spindle 26 by a rotor clamp 52 that is, in turn, selectively mounted on the spindle 26. Both the rotor 51 and the rotor clamp 52 are preferably made of a paramagnetic material such as aluminum.

The rotor 51 has an annular body portion 53, the central aperture 54 of which slidably engages the spindle 26. Within the rear face 55 of the body portion 53 are four recesses 56A–56D (FIG. 3 and partially in FIG. 7) disposed circumferentially about the central aperture 54 in a quadrate fashion. As such, each recess is disposed at right angles to the next successive recess. A bar magnetic 58 is received within each recess; the successive bar magnets 58A through 58D being disposed so that the common poles are adjacent, as designated by the letters "N" and "S" on FIG. 3. In that way a magnetic field is created about the rotor with alternating north and south poles every 90 degrees.

A skirt portion 59 (FIG. 7) extends axially outwardly from the hub of the annular body portion 53 and is crenelated with a plurality of notches 60 which will serve as clamping locators. In order, for example, to permit indexing of the axis angle $\alpha$ at 10° increments, 36 such notches 60 are spaced at 10° intervals about the periphery of the skirt portion 59. These notches 60 interact with a retractable positioning pin such as the set screw 61 presented from the rotor clamp 52.

The rotor clamp 52 also has an annular body portion 62, the central aperture 63 of which slidably engages the spindle 26. A pair of bores 64 (only one is depicted) may be drilled radially through the body portion 62 and tapped to receive a pair of corresponding set screws 65. The set screws are employed to secure the position of the rotor clamp 52 circumferentially, and axially, with respect to the spindle 26.

The central aperture 63 of the rotor clamp 52 is counterbored, as at 66, to receive the crenelated skirt portion 59 of the rotor portion 51 and thereby permit the rotor portion 51 and the rotor clamp 52 to be disposed in contiguous juxtaposition to each other and be, in turn, disposed against the spindle drum 68.

A bore 69 is spaced radially outwardly of the central aperture 63. Bore 69 is oriented parallel to the axis 34 of the spindle 26 on which the rotor clamp 52 is received to intersect the counterbore 66. Bore 69 may be tapped to receive a set screw that can serve as the positioning pin 61.

A peripheral flange 70 extends radially outwardly from the body portion 62 of the rotor clamp 52, and it may be chamfered to a knife edge 71 that terminates adjacent the cylindrical outer surface 72 on the rotor.

A radially oriented kerf 73 may be provided axially through at least the flange 70 to serve as a lubber for the angularity scale 74 imprinted on the periphery of the cylindrical outer surface 72 on the rotor 51.

As will hereinafter become more apparent, one can first set the lubber kerf 73 to 0° on the angular index scale 74 and engage the positioning pin 61 with the appropriate notch 60. Thereafter the rotor 51 and rotor clamp 52 are simultaneously positioned with respect to the spindle 26 so that the lathe will cut the meridian 21A of the steeper radius of curvature coincident with the 0°–90° plane of the lens. That determines the fixed position of the rotor clamp 52 with respect to the spindle 26. To select an axis angle $\alpha$ other than 0° the rotor 51 is positioned until the desired degree of angularity on the angularity scale 74 of the rotor 51 aligns with the lubber kerf 73. By virtue of the thus established circumferentially angular orientation of the magnetic field created by the rotor 51 with respect to the spindle 26, the desired axis angle $\alpha$ can be achieved so long as the orientation of the dop 29 is fixedly positioned with respect to the spindle. Hence, a locating slot 81 (see FIG. 9) extends axially along the outer surface 82 of the dop shaft 83 to receive an aligning blade, or pin, 84 fixedly presented from within the chuck 28. The location of the aligning blade 84 with respect to both the eccentricity of the dop 29 and the orientation of the rotor 51 thus assures that the axis angle $\alpha$ of the lens will be properly located to assure the necessary positioning of the prismatic ballast point 14B.

Rotation, with the spindle 26, of the four bar magnets 58A–58D carried by the rotor 51 generates an alternating current signal by virtue of the induction coil 75 wrapped about the ferromagnetic core 76 (FIGS. 3 and 6). Specifically, the magnetic field created by the four bar magnets 58A–58D is caused to move relative to the conductive wire 78 forming the coil 75, and that motion generates an alternating current signal within the conductor by virtue of electromagnetic induction whenever the conductor forms a closed circuit. The leads 79A and 79B of the conductor wire 78 emanating from the coil 75 are thus connected to the tool post oscillator 90, as hereinafter more fully explained. A cap 80, also made of a paramagnetic material such as aluminum, is preferably positioned to shield the coil from extraneous electromagnetic interference that might degrade, or alter, the alternating current signal induced in the coil 75 by the rotor 51 in response to rotation of the spindle 26.

Tool Post Oscillator

The tool post oscillator 90 (FIGS. 4, 5 and 6) is supported from a base 91 that dovetails within a ramp fitting 31D carried on, and movable radially with, a slide block 31A supported by the quadrant arm 35.

As should be apparent from FIG. 6, the quadrant 31 comprises a bearing cartridge 92 that is rotatably received within the bed 32 of the lathe 25 to provide accurate rotational movement about the vertical axis 33. The quadrant arm 35 is affixed to the bearing cartridge 92 and extends radially therefrom to be swung arcuately in response to rotational movement of the bearing cartridge 92. A slide block 31A is selectively positionable along the quadrant arm 35 to adjust the radius at which the cutting tool 36 supported therefrom is swung with respect to the vertical axis 33.

An adaptor plate 31B is, in turn, secured to the slide block 31A, and the plate 31B is recessed, as at 31C, to receive a ramp fitting 31D. The ramp fitting 31D is secured within the milled recess 31C of the adaptor plate 31B with an epoxy cement to provide a break-away connection. Inasmuch as the spindle 26 is rotatably mounted on precision bearings an operator's mistake that would permit the tool 36, or the mechanism on which it is mounted, inadvertently to swing into engagement with the dop 29 or the spindle 26 could effect considerable physical damage to the lathe 25. Thus, although a solid connection can be employed, in order to obviate potential damage to the lathe and its attachments the aforesaid break-away connection can be employed.

Adjustment of the base 91 with respect to the ramp fitting 31D, by virtue of the angular inclination of the recess 94 within the base 91 and the mating dove tail 94A on the ramp fitting 31C, permits selecting the elevation of the cutting tool 36 with respect to the axis 24 of the spindle 26, as would likely be required each time the cutting tool 36 is changed.

Independent of the aforesaid elevational adjustment, the selective location of the slide block 31A along the quadrant arm 35 determines the radius about which the tool 36 is swung with respect to the vertical axis 33.

A motor mount 95 is secured to the frame 96 of a fractional horse power motor 98, and the mount 95 is, in turn, secured to the base 91. The motor shaft 99 extends through the mount 95 as well as the base 91 for nonrotatable connection to the unique oscillatable tool post 100. Before continuing with the description of the tool post 100 itself, let us review how the alternating current signal from generator 50 is applied to the motor 98.

The motor 98 is preferably a permanent magnet, DC motor from which the brushes have been removed. The leads 79A and 79B are operationally secured to the single coil 101 on the armature 103 of the motor 98. In that way the alternating current signal induced by generator 50 will cause the motor shaft 99 to oscillate about its own axis through a given degree of angular rotation.

It is quite likely that the signal induced by the generator 50 may not be sufficient to effect the desired amplitude of oscillation, and to enhance the induced signal it may be amplified.

In operation, the spindle 26 of lathe 25 is preferably rotated in the range of approximately 6000 to 9000 rpm. Although it is believed that the spindle 26 may be rotated outside this range effectively to produce a toric lens, it should be appreciated that the maximum speed should be maintained well below that which could induce a forced vibrational response into the hereinafter described flex beam 115. At speeds slower than those stated to define the preferred range, the arrangement is deemed to work quite well, but the cycling time becomes sufficiently slow that manufacturing efficiency would suffer. These considerations determined the selection of the preferred speed range.

The use of the four magnets 58A–58D, as previously described, in the rotor 51 creates two cycles of the generated alternating current signal for each rotation of the spindle 26. Thus, for the rotational speeds of the spindle 26 in the preferred range under consideration, the resulting signal will fall within the range of approximately 200 to 300 Hertz. Signals in this range can be effectively amplified by an audio amplifier, as is represented at 105. By the use of a high quality audio amplifier 105, that will not distort the amplified signal, the gain, as selected by control knob 104, of the output signal can be applied to motor 98 to control the range of the rotational movement through which the shaft 99 can oscillate.

Figure 4:
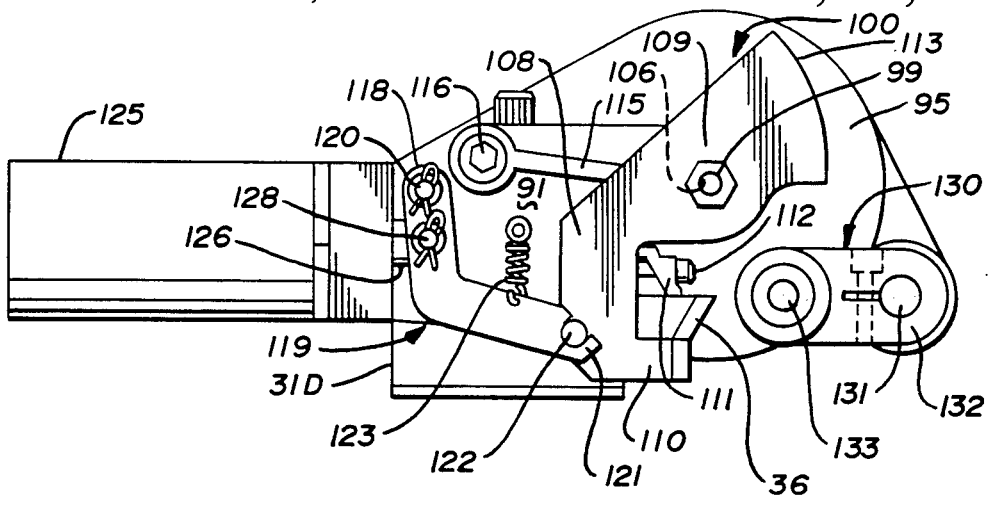
FIG. 4 is an enlarged, frontal elevation taken substantially along line 4—4 of FIG. 3 and depicting the tool post oscillator mechanism.
Figure 5:
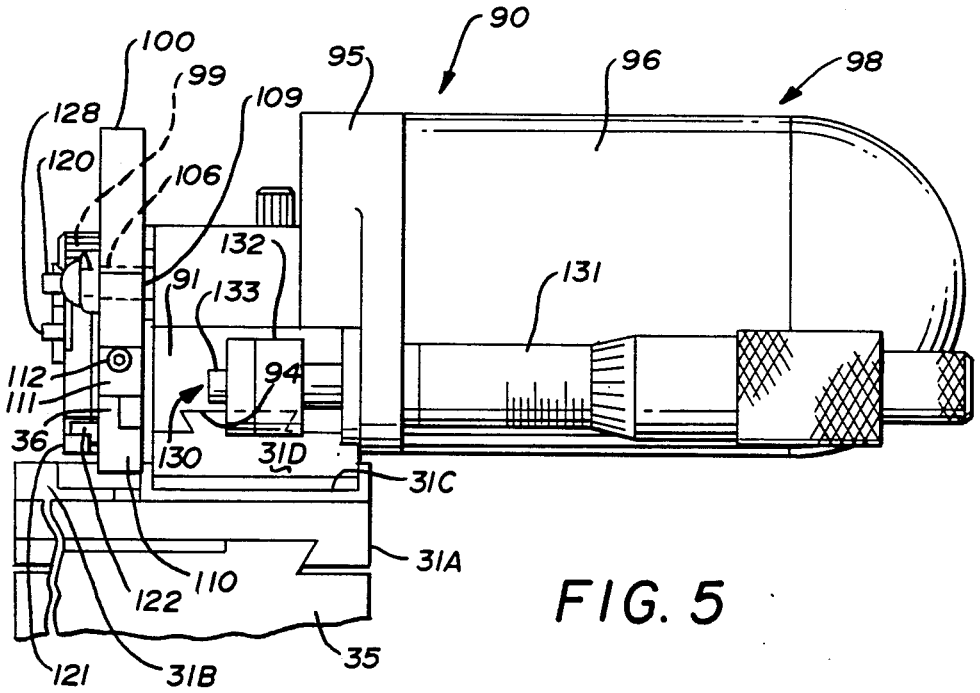
FIG. 5 is a side elevational view of the mechanism depicted in FIG. 4 and taken substantially along line 5—5 of FIG. 4.

Returning now to the description of the tool post 100, as best seen in FIGS. 4 and 5, it is centrally bored, as at 106, to receive the motor shaft 99. A leg portion 108 extends downwardly from the hub portion 109 and terminates in a foot 110 on which the customary diamond cutting tool 36 is supported. A tool slave 111 locks the tool 36 in place and is secured to the leg portion 108, as by machinist's socket head screws 112. A counterbalance mass 113 extends outwardly from the hub portion 109 in general opposition to the mass of the leg and foot portions 108 and 110, respectively, to assure a rotational balance for the oscillations imparted thereto by motor 98.

In order dynamically to provide an elastic restraint to the tortional vibrations of the tool post 100 and to provide a return spring action, thereby further to assure that the tool post 100 accurately reflects a movement in conformity with the sinusoidal signal created by the generator 50, a flex beam 115 extends from in proximity the hub portion 109 to be remotely anchored to the base 91 by pin 116.

One end 118 of a dog leg lock arm 119 is supported for swinging movement on a pivot pin 120 that extends outwardly from the base 91. The opposite end of the lock arm 119 terminates in a bifurcated jaw 121 that is adapted to engage a lock pin 122 which extends outwardly from the leg portion 108 of the tool post 100. When the pin 122 is received within the jaw 121 the tool post 100 is immobilized and thus incapable of oscillating about the motor shaft 99. A spring 123 is connected between the lock arm 119 and the tool post base 91 normally to bias the jaw 121 into locking engagement with the pin 122.

A solenoid 125 is also supported from the base 91, and the solenoid plunger 126 is connected to the lock arm 119, as by pin 128, so that actuation of the solenoid 125 will retract the plunger 126 to disengage the jaw 121 from the lock pin 122. Conversely, when the solenoid 125 is deactivated, the spring 123 swings the arm 119 to bring the jaw 121 into engagement with the pin 122 in order to assure immobilization of the tool post 100.

A variation of the prior art sensor mechanism 130 is supported from the motor mount 95. Specifically, a micrometer spindle 131 is anchored to the motor mount in order to translate the sensor block 132 from which the sensor pin 133 extends. The micrometer spindle 131 permits accurate axial positioning of the sensor pin 133 which, when brought into engagement with the base 42 of the window 41 in the lens blank 30, is registered in the electronic control of the lathe 25 to determine the maximum extension of the spindle 26 during the lens cutting procedure, as is well known to the prior art.

Modulator

A modulator 140 (FIGS. 3 and 6) interacts in response to rotational movement of the quadrant 31 to effect a responsive control of the signal produced by the generator 50 before it is received by the tool post oscillator 90 in order to determine the amplitude of the cutting tool oscillations relative to the angle $\psi$ between the plane 36A of the cutting tool 36 and the centerline of the spindle 26 and thereby effect an intersection of the orthogonal curves forming the toricity of the optical zone 18 at a common apex 22.

The modulator housing 141 is supported by a post (not shown) that is affixed to the bed 32 of the lathe 25. The housing 141 is constructed to achieve rotational actuation of the potentiometer 143 in response to linear movement of the slide block 144.

The slide block 144 reciprocates linearly in a dovetail way 145 machined into the upper surface 146 of the housing 141. The way 145 is slotted parallel to its axis 147 in order to permit a spacer pin 148 which depends from the slide block 144 to extend into the interior cavity 149 of the housing 141.

Figure 10:
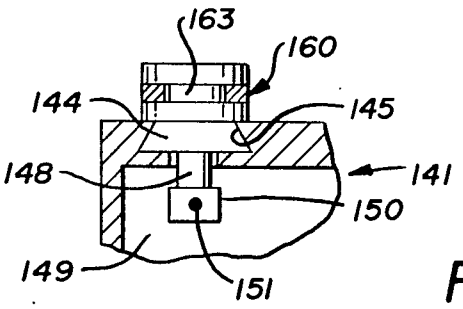
FIG. 10 is an enlarged sectional view taken substantially along line 10—10 of FIG. 6 and depicting a portion of the interior of the housing secured to the lathe and associated with the modulator.

As best seen in FIG. 10, a flexible, nonextendable cable 151 is secured to an anchor block 150 carried on the spacer pin 148. The cable 151 is reeved around a turning block in the form of a pulley 152 rotatably supported within the cavity 149 of the housing 141 on the lathe side of the anchor block 150. A second turning block in the form of a pulley 153 is also rotatably supported within the cavity 149. The second pulley 153 is spaced laterally of the first pulley 152, and directs the cable 151 to a third pulley 154 that is fixedly secured to the rotatable operating shaft 155 of the potentiometer 143.

In order to secure a sufficient purchase on the pulley 154 so that translation of the cable 151 will assure a corresponding rotation of the potentiometer operating shaft 155, it may be highly desirable to take at least one wrap of the cable 151 about the pulley 154.

The end of the cable 151 beyond the pulley 154 is secured to one end of a tension spring 156, the other end of which is anchored within an extension 158 of the housing 141.

As best seen in FIG. 6, one end of the crank link 160 is pivotally secured to the quadrant 31, as by the pivot pin 161. The opposite end of the crank link 160 is provided with an axially oriented, lost motion slot 162 which slidably, and rotatably, engages a crank pin 163 secured to, and extending upwardly from, the slide block 144.

Figure 8:
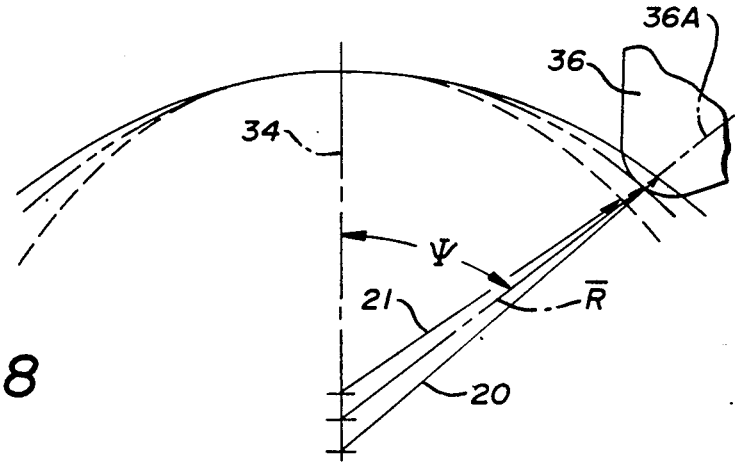
FIG. 8 is a schematic representation of the cutting tool in relation to the extended centerline of the lathe spindle to depict the angular relationship therebetween and also to depict the two radii which define the orthogonal meridians of a toric surface as well as the average radius employed to determine the arcuate swing of the lathe quadrant, said figure appearing on the same sheet of drawings as FIGS. 1 and 2.

The geometry of the crank link 160, and its dimensions, are chosen to effect the following parameters. During that swing of the bearing cartridge 92 such that the acute angle $\psi$ (heretofore defined as the angle between the plane 36A of the cutting tool 36 and the centerline 34 extension of the spindle 26, as schematically depicted in FIGS. 3 and 8) is greater than 30°, the lost motion slot 162 slides past the crank pin 163 without affecting any translation of the slide block 144. During any and all movement of the quadrant 31 within a range of movement where the angle is greater than 30° the biasing action of the tension spring 156 maintains the cable 151 at the limit of its full range of motion as determined by the operating shaft 155 of potentiometer 143. As will hereinafter become apparent from the operational explanation, the potentiometer is, at this time, at its lowest resistance.

As the quadrant 31 rotatably swings to reduce the angle $\psi$ to 30° the driving end 164 of the lost motion slot 162 is moved into engagement with the crank pin 163 such that any further reduction of the angle $\psi$ translates the slide block 144 within its way 145. Continued reduction of the angle $\psi$ continues to translate the slide block 144 until the angle is reduced to 0°. At that point the axis 165 of the crank link 160 is aligned with the axis 147 of the slide block 144. The diameter of the pulley 154 which actuates the potentiometer 143 is selected to achieve full rotation of the potentiometer operating shaft 155 within the aforesaid 30° rotation of the quadrant 31 from an angle $\psi$ that equals 30° to an angle that equals 0°. Typically, the potentiometer shaft would have a rotational range of approximately 300° from stop to stop, and it is important that as the angle $\psi$ approaches 0° the potentiometer should be at its maximum resistance.

Switch/Ramp Control

Figure 11:
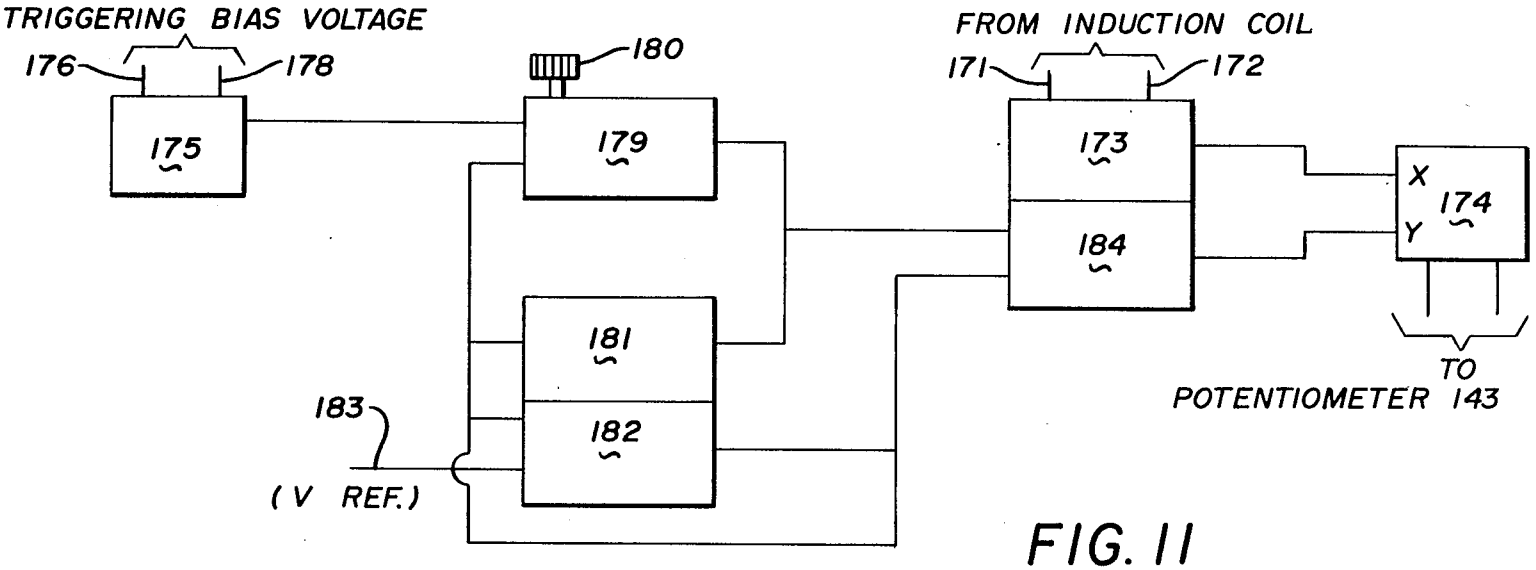
FIG. 11 is a schematic block diagram of the circuitry employed in the typical switch/ramp control portion of the subject invention.

The switch/ramp control 170 is depicted in FIGS. 3 and 11. As shown therein, the sinusoidal AC output from the signal generator 50 is supplied, at 171 and 172, as the input to an operational amplifier (hereinafter "op amp") 173 that may well be one half of a dual op amp such as a National LM1458N integrated circuit. Op amp 173 amplifies the signal received to a usable value that is then fed into the "X" input of a quadrant multiplier 174. One may use an Intersil ICL8013CCTZ as the quadrant multiplier 174, which serves as a voltage control gain circuit in that the voltage level applied to the "X" input is multiplied by the voltage level applied to the "Y" input, which, as will hereinafter become more apparent, is a DC control voltage.

The switch/ramp control 170 also incorporates a switching arrangement 175 that responds to a triggering bias voltage applied at 176, 178. The switching arrangement 175 may well comprise a quad, CMOS NAND gate arrangement such as the RCA CD70118CP integrated circuit wired as a flip-flop to act as a switch that is normally, in effect, "open" but which will effectively "close" when subjected to a triggering voltage bias above a predetermined threshold value.

When the triggering voltage changes the state of the NAND gate flip-flop to effect a "closed" circuit, the output signal from the flip-flop is fed to a timing arrangement in the form of a feedback circuit 179 that incorporates a potentiometer to select—by adjusting knob 180—the charging time of capacitor connected in parallel with a diode and a zener diode, all of which are connected in parallel across an op amp 181 acting as an integrator. Op amp 181 may be provided as half of a dual op amp integrated circuit such as a National LM1458N, and the other half thereof, op amp 182, may serve as the stabilizer by which to supply a uniform reference voltage to op amp 181, from a voltage supply applied at 183.

The integrator effects a ramped DC output voltage that is fed to an op amp 184 that serves as a translator whereby the DC voltage from the integrator op amp 181 is changed to a more usable level for application to the "Y" input of the quadrant multiplier 174. The op amps 173 and 184 may also be halves of a second dual op amp such as the National LM1458N integrated circuit.

In any event, the amplitude of the AC input signal applied at "X" is multiplied by the value of the DC voltage applied at "Y" to determine the output signal emanating from the quad amplifier, across 185 and 186.

Inasmuch as the integrator has two stable states—one for each condition of the flip-flop—the output from the quad amplifier is a stable null when less than the threshold triggering voltage is applied to the switching arrangement. Likewise, the output is stable after ramping. As such, the switch/ramp control 170 is capable of dwelling in the triggered condition for extended periods of time without change to the output voltage.

The use of a capacitor in parallel with a diode and a zener diode across the op amp 181 which functions as the integrator achieves a slow charging time for the capacitor in order to permit a ramped DC output from the integrator, and yet this arrangement drops the output voltage to a null within 50 milliseconds when the triggering voltage drops below the threshold value.

The foregoing arrangement exemplifies the desired switch/ramp circuit 170 in that the output signal is in phase with the input signal, the output signal is free of harmonics and extraneous noise and the output is virtually undistorted.

Finally, such an arrangement is capable of operating from a 12 volt DC power source, and it can be provided on a single printed circuit board with all external connections being made through a reed connector, not shown.

Operation

In order to make a toric lens 10 on a lathe 25 equipped with an attachment embodying the concept of the present invention, the operator seats a dop 29, to which a lens blank 30 has been secured, in the chuck 28 of the lathe 25.

The positioning pin 61 is loosened to permit rotational positioning of the rotor 51 with respect to the rotor clamp 52 until the desired axis angle imprinted on the angularity scale 74 presented from the rotor 51 aligns with the lubber kerf 73 on the rotor clamp 52. The positioning pin 61 is then tightened into the appropriate notch 60 to secure the rotor 51 in its selected position.

The operator will then refer to the prescription to be cut into the lens and from the spherical and cylinder diopter correction required, determine both the flat radius 20 and the steep radius 21 of curvature required to produce the desired toricity. The average of these two radii of curvature is then calculated and the slide block 31A is positioned with respect to the quadrant arm 35 so that rotation of the quadrant 31 will move the cutting tool 36 through an arc equal to the aforesaid average radius $\bar{R}$ (FIG. 8).

The sensor mechanism 130 is then set to determine the final thickness of the finished lens. Thereafter, a first, standard, spherical, pre-cut is made to remove the corners of the lens blank, and a second, standard, spherical, pre-cut is made to bring the lens blank into within approximately 0.02 mm over the final thickness of the lens.

The final cut is then initiated.

The extension of the spindle 26 and the rotational swing of the quadrant 31 about axis 33 are accomplished in the customary fashion, as are the two previously accomplished pre-cuts, with the jaw 121 of the lock arm 119 firmly engaging the lock pin 122 to assure that the cutting tool 36 remains absolutely immobilized on, and moves solely in conformity with, the rotational swing of the quadrant 31. During this portion of the cutting cycle the carrier surface 13 is cut spherically to the average $\bar{R}$ (FIG. 8) of the two radii 20 and 21 required to define the corrective toricity to be imparted to the surface 16 of the optical zone 18. At the same time the carrier surface 13 is being cut the eccentricity between the spindle 26 and the dop 29 simultaneously also imparts the prismatic ballast, as is heretofore well known to the art.

When the angle $\psi$ approaches 30°, the electronic control mechanism of the standard lathe 25 provides a trigger signal to the switch arrangement 175 of the switch/ramp control 170. When triggered, the normally "open" switch arrangement 175 of the switch/ramp control 170 initiates ramping. The trigger signal also serves to actuate solenoid 125 to retract the jaw 121 from engagement with the lock pin 122.

The sinusoidal signal produced by the generator 50 in response to rotation of the spindle 26 is instantly nulled by the switch/ramp control 170 and then ramped to its maximum strength over the time interval established for the ramping thereof as heretofore explained in conjunction with the disclosure of an exemplary switch/ramp control 170. This ramped sinusoidal signal is fed to the input—terminals 192 and 193—of the audio amplifier 105; it is amplified; and, the output—leads 79A and 79B from terminals 194 and 195—is applied to the motor 98. The strength of the output signal, as manually set by the gain control knob 104 of the amplifier 105, determines the amplitude of the cutting tool oscillations. Thus, by ramping the signal the cutting tool 36 is gradually transitioned from no oscillations to oscillations of the maximum amplitude necessary to achieve the desired toricity. That portion of the lens 10 that is cut during this ramping of the signal is the annular transitional surface 15.

It should be understood that the gain of the amplifier 105 determines the amplitude of the cutting tool 36 movement on either side of the reference average radius $\bar{R}$ to which the carrier surface 13 was cut. The exact setting of the gain control, by knob 104, necessary to achieve a given amplitude for the cutting tool oscillations may be empirically determined.

With the gain of the amplifier 105 pre-set in accordance with the empirically determined value, when the signal has fully ramped the cutting tool 36 will make the maximum incursions required to cut the steeper curve having the lesser radius 21 and alternately the maximum retraction required to cut the flatter curve having the larger radius 20. As such, the full signal produced by the generator 50 is fed to the input terminals 196 and 198 (FIG. 3) of the modulator 140 and virtually the same signal is fed from the output terminals 199 and 200 of the modulator to the input terminals 192 and 193 of the amplifier 105, wherein it is amplified to the preselected magnitude. At least the full signal produced by the generator 50 is initially supplied to the amplifier 105 after the signal has been ramped.

As the quadrant 31 swings from a position where the angle $\psi$ equals approximately 30° toward that position where the angle $\psi$ is reduced to 0°, the modulator 140 rotates the shaft 155 of the potentiometer 143. As depicted schematically in FIG. 3, this rotation of the potentiometer shaft 155 effectively moves the slide contact 190 along the resistance element 191 to increase the resistance between the output (terminals 185 and 186) of the switch/ramp control 170 and the input (terminals 192 and 193) of the amplifier 105. This increasing resistance modulates the voltage magnitude of the signal as a function of the cosine of the angle $\psi$. Specifically, the modulation, as a function of the input/output voltage is:

$$\text{Output Voltage} = (\text{Input Voltage})\ (1 - \text{cosine}\ \psi)$$

Accordingly, as the angle $\psi$ is reduced toward 0°, the output voltage is also reduced to 0. This effects gradually lesser and lesser amplitude to the oscillations of the cutting tool 36 such that when the tool 36 is actually cutting the apex 22 of the toric surface 16 the tool 36 is subjected to no oscillations and the two curves thus have fully merged into the common apex 22.

Conclusion

It should now be apparent that a unique toric lens 10 can be directly lathe-cut by the method and apparatus of the present invention, and reasonable equivalents thereof, which also otherwise accomplishes the objects thereof.

I claim:

1. A method for generating a toric surface comprising the steps of:
- mounting a lens blank onto which a toric surface is to be imparted on the spindle of a lathe;
- rotating said spindle;
- providing a cutting tool to shape the blank mounted on said spindle; moving said cutting tool through an arcuate path transversely of said spindle;
- oscillating said cutting tool so that it moves through a range to cut a curve of first selected radius at the innermost incursion of its oscillation and at least a curve of second selected radius at its outermost retraction; and,
- effecting synchronization of the tool oscillations with respect to rotation of the spindle to orient the curve of said second selected radius orthogonally to the curve of said first selected radius.

2. A method for generating a toric surface, as set forth in claim 1, which comprises the further step of:
- modulating the amplitude of the oscillations of the cutting tool in accordance with preselected parameters.

3. A method for generating a toric surface, as set forth in claim 1, wherein synchronization is achieved by:
- generating a control signal in response to the rotation of the spindle; and,
- oscillating the cutting tool in response to said control signal.

4. A method for generating a toric surface, as set forth in claim 1, wherein synchronization is achieved by:
- generating a signal having a sinusoidal waveform in response to rotation of the spindle; and,
- oscillating the cutting tool in response to said signal.

5. A method for generating a toric surface, as set forth in claim 4, wherein oscillation of the cutting tool in synchronization with rotation of the spindle is achieved by:
- mounting the cutting tool radially of a rotatably oscillatable shaft;
- providing a fixed magnetic field radially of the oscillatable shaft;
- mounting a coil on the oscillatable shaft; and,
- passing said signal through the coil to create a polarity reversing magnetic field to be interactive with the fixed magnetic field and thereby oscillate the shaft.

6. A method for generating a toric surface, as set forth in claim 5, including the additional step of:
- damping the rate of change of the oscillatory motion of the shaft.

7. A method for generating a toric surface, as set forth in claim 1, comprising the additional steps of:
- determining the centerline of the spindle;
- presenting a cutting tool from a lathe quadrant that arcuately swings the tool across the blank in angular relation to the centerline of the spindle; and,
- modulating the amplitude of the oscillations of the cutting tool in accordance with the angular relation of the cutting tool with respect to the centerline of the spindle.

8. A method for generating a toric surface, as set forth in claim 7, wherein modulation of the amplitude is achieved by:
- generating a control signal in response to the rotation of the spindle;
- oscillating the cutting tool in response to said control signal generated by rotation of the spindle;
- applying the full signal strength to achieve maximum oscillation;
- nulling the signal to preclude oscillation; and,
- modulating the signal between full and null in response to the angular relation of the cutting tool with respect to the centerline of the spindle.

9. A method for making a lens having a toric surface comprising the steps of:
- mounting a lens blank on the spindle of a lathe;
- rotating said spindle;
- providing a cutting tool to shape the blank mounted on said spindle; moving said cutting tool through an arcuate path transversely of said spindle;
- cutting a non-toric surface about the lens blank;
- oscillating said cutting tool selectively so that it moves through a range to cut a toric surface having a first selected radius generated by the innermost incursion of said cutting tool and at least a second selected radius generated by the outermost retraction of said cutting tool; and,
- effecting synchronization of the tool oscillations with respect to rotation of the spindle to orient the curve of said second selected radius orthogonally to the curve of said first selected radius.

10. A method for making a lens, as set forth in claim 9, which comprises the further steps of:
- locating the non-toric surface concentrically with respect to the toric surface; and,
- cutting a transition surface to interface the non-toric surface with the toric surface.

11. A method for making a lens, as set forth in claim 10, wherein synchronization is achieved by:
- providing a driving signal dependent upon the rotational position of the spindle; and,
- oscillating the cutting tool selectively in response to said driving signal.

12. A method for making a lens, as set forth in claim 11, wherein said driving signal is achieved by:
- generating a signal having a sinusoidal waveform in response to rotation of the spindle; and, passing said signal through a switch/ramp control to vary the amplitude of said signal from null to full as a function of time.

13. A method for making a lens, as set forth in claim 12, wherein said transition surface is achieved by:

determining the centerline of the spindle;

presenting a cutting tool from a lathe quadrant that arcuately swings the tool across the blank in angular relation to the centerline of the spindle; and exposing the cutting tool to the driving signal through a preselected angular displacement of the lathe quadrant as the amplitude of said signal varies from null to full.

14. A method for making a lens, as set forth in claim 11, wherein said non-toric surface is achieved by:

determining the centerline of the spindle;

presenting a cutting tool from a lathe quadrant that arcuately swings the tool across the blank in angular relation to the centerline of the spindle; and, isolating the cutting tool from the driving signal during a preselected angular displacement of the lathe quadrant.

15. A method for making a lens, as set forth in claim 14, wherein said non-toric surface is further achieved by:

fixing the cutting tool relative to the lathe quadrant during said preselected angular displacement.

16. A method for making a lens, as set forth in claim 11, wherein said toric surface is achieved by:

determining the centerline of the spindle;

presenting a cutting tool from a lathe quadrant that arcuately swings the tool across the blank in angular relation to the centerline of the spindle;

exposing the cutting tool to the driving signal; and, modulating the amplitude of the oscillations of the cutting tool in accordance with the angular relation of the cutting tool with respect to the centerline of the spindle.

17. A method for making a lens, as set forth in claim 16, wherein modulation of the amplitude is achieved by:

applying full signal strength to achieve maximum oscillation;

nulling the signal to preclude oscillation; and, modulating the signal between full and null in response to the angular relation of the cutting tool with respect to the centerline of the spindle.

* * * * *